US006101767A

United States Patent [19]

Georgeau

[11] Patent Number: 6,101,767

[45] Date of Patent: Aug. 15, 2000

[54] STRUCTURAL TERMINATION SYSTEM

[75] Inventor: Phillip C. Georgeau, Kalamazoo, Mich.

[73] Assignee: Chem Link, Inc., Kalamazoo, Mich.

[21] Appl. No.: 09/095,441

[22] Filed: Jun. 10, 1998

[51] Int. Cl.[7] ..... E04D 1/24

[52] U.S. Cl. ..... 52/62; 52/59; 52/58; 52/94; 52/96; 52/97

[58] Field of Search ..... 52/62, 59, 58, 52/94, 96, 97, 732.1

[56] References Cited

U.S. PATENT DOCUMENTS

| | | | |
|---|---|---|---|
| 1,710,484 | 4/1929 | Luther | 52/58 |
| 2,857,861 | 10/1958 | Trostle . | |
| 3,204,375 | 9/1965 | Kotarski . | |
| 3,242,622 | 3/1966 | Snead . | |
| 3,432,976 | 3/1969 | Berg . | |
| 3,469,357 | 9/1969 | Seidler . | |
| 3,668,811 | 6/1972 | Pollard . | |
| 3,680,269 | 8/1972 | Fischer, Jr. et al. . | |
| 3,862,531 | 1/1975 | Attaway et al. | 52/58 X |
| 4,483,112 | 11/1984 | Rueblinger | 52/94 |
| 4,598,507 | 7/1986 | Hickman | 52/94 |
| 4,662,129 | 5/1987 | Hickman . | |
| 4,686,803 | 8/1987 | Couderc et al. | 52/97 |
| 4,798,033 | 1/1989 | Weidl . | |
| 4,800,689 | 1/1989 | Lane . | |
| 5,031,367 | 7/1991 | Butzen . | |
| 5,239,791 | 8/1993 | Mills, Jr. et al. | 52/58 |
| 5,272,846 | 12/1993 | Kelley et al. . | |

FOREIGN PATENT DOCUMENTS

| | | | |
|---|---|---|---|
| 937021 | 11/1973 | Canada | 52/62 |
| 0090245 | 3/1983 | European Pat. Off. . | |
| 2333959 | 7/1973 | Germany . | |
| 2233714 | 1/1974 | Germany | 52/94 |
| 2553134 | 11/1975 | Germany . | |
| 2906453 | 8/1980 | Germany | 52/58 |
| 406240829 | 8/1994 | Japan | 52/58 |
| 212315 | 4/1967 | Sweden . | |
| 856852 | 12/1960 | United Kingdom . | |
| 910393 | 11/1962 | United Kingdom . | |
| 1347974 | 2/1974 | United Kingdom . | |
| 2084628 | 4/1982 | United Kingdom | 52/96 |

*Primary Examiner*—Carl D. Friedman
*Assistant Examiner*—Phi Dieu Tran A
*Attorney, Agent, or Firm*—Price, Heneveld, Cooper, DeWitt & Litton

[57] ABSTRACT

A structural termination system includes a one-piece elongated structural member having an outer wall and a horizontal bottom wall defining a lower surface having substantially the same contour as an upper surface of an associated building wall, wherein the building wall is characterized by the absence of a wood nailer structure adjacent the upper surface of the building wall. The structural member further includes a drip edge extending downwardly from the outer wall such that the outer wall and drip edge cooperate to define an integral fascia. Structural adhesive is disposed on the lower surface of the elongated structural member and securely bonds the structural member directly to an upper surface of an associated building wall without a wood nailer structure or mechanical fasteners along the structural member.

19 Claims, 2 Drawing Sheets

STRUCTURAL TERMINATION SYSTEM

BACKGROUND OF THE INVENTION

The present invention relates to a structural termination system for securing a perimeter of a low slope roof layer to an exterior building wall, and in particular to a structural termination system that is adhesively bonded directly to the building wall to eliminate the need for a wood block nailer structure.

Low or flat slope roofs are often covered by one or more roof membranes. The roof membrane may be adhesively bonded to the roof, or may be covered with loose-laid ballast to retain the membrane. Wind may generate substantial uplift forces, which can cause the edge of the roof membrane to peel upwardly, causing substantial damage to the roof structure.

Various methods have been developed to secure the edge of the roof membrane and insulation. Available roof edging systems include one or more wood block "nailer" strips which are fastened along the upper edge of the wall or roof deck by use of mechanical fasteners, such as large bolts. A wood cant having a triangular cross-sectional shape is mechanically fastened to the top of the wood nailer to provide a gravel stop for ballasted loose-laid roof systems. The wood block nailer generally has a thickness that is equal to the insulation covering the roof deck such that the roof membrane will lie flat across the wood nailer-to-insulation interface. One or more sheet metal flashing members are secured to the wood nailer and cant by mechanical fasteners, such as screws. The roof membrane fits under the flashing, such that the flashing secures the edge of the membrane. A sheet metal fascia cap fits over the flashing, and extends downwardly along the outer face to form a drip rail. A continuous cleat strip is installed in back of the drip rail to secure the drip rail to the nailer structure.

Available edge-securing systems require a wood block nailer structure to receive the mechanical fasteners that are used to attach the flashing, fascia cap and cleat strip. The wood block nailer structure is generally cut to size and installed at the building site. The wood block nailer structure is generally secured to the building roof and/or wall, using mechanical fasteners, and the flashing and fascia cap are installed to the wood block nailer structure using mechanical fasteners. The need to fit the wood block nailer structure at the installation site, as well as the need to install numerous mechanical fasteners results in an installation procedure having numerous labor-intensive steps.

Furthermore, the sheet metal fascia cap and/or flashing can separate from the nailer structure due to wind loading. This results in substantial damage to the roof structure, and may lead to further building damage due to water entering the building.

Accordingly, a structural termination system that alleviated the above-mentioned problems was desired.

SUMMARY OF THE INVENTION

One aspect of the present invention is to provide a structural termination system for securing the perimeter of a low slope roof layer to the exterior wall of an associated building. The structural termination system includes a one-piece elongated structural member defining an outer wall and a horizontal bottom wall defining a lower surface having substantially the same contour as an upper surface of an associated building wall that is characterized by the absence of a nailer structure. The structural member further includes a drip edge extending downwardly from the outer wall such that the outer wall and drip edge cooperate to define an integral fascia. A thermosetting elastomeric structural adhesive is disposed on the lower surface of the elongated structural member and securely bonds the structural member directly to the upper surface of an associated building wall without a wood block nailer structure or mechanical fasteners along the structural member.

Another aspect of the present invention is a one-piece structural member for securing the perimeter of an associated roof to an associated building wall. The one-piece structural member has a tubular cross-sectional shape defining a quadrilateral perimeter with at least one web extending approximately vertically across the perimeter to define a pair of quadrilateral side-by-side passages. A generally planar bottom surface of the structural member defines an area sufficiently large to permit secure bonding of the structural member directly to an upper surface of an associated building wall to thereby secure the perimeter of the roof without a wood block nailer structure or mechanical fasteners along the structural member.

Yet another aspect of the present invention is a method of securing a roof edge including the steps of providing an elongated member. Adhesive is applied to a selected one of the structural member and an upper surface of a building wall. The structural member is positioned directly on the upper surface of the building wall and manually pressed in place. The adhesive is cured to securely bond the structural member to an upper surface of the building wall without the use of a wood nailer structure.

Yet another aspect of the present invention is a structural termination system including a building wall that is characterized by the absence of a nailer structure along an upper edge thereof. The building wall is formed of a structural building material that defines an upper surface of the building wall. An elongated structural member is adhesively bonded to the upper surface of the building wall and securely retains an edge of the associated roof layer.

Yet another aspect of the present invention is a one-piece structural member for securing the perimeter of an associated roof to an associated building wall. The one-piece structural member has an outer wall and a generally planar upper surface, and a generally planar bottom surface that defines an area sufficiently large to permit secure bonding of the structural member directly to an upper surface of an associated building wall to secure the perimeter of the associated roof without us of a nailer structure or mechanical fasteners along the structural member. The planar upper surface is spaced vertically from the lower surface a distance substantially equal to the thickness of the deck and insulation layer of the associated roof to provide an attachment location for a top layer of an associated roof. The structural member thereby replaces wood nailer structures and provides a one-piece attachment for the roof perimeter.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
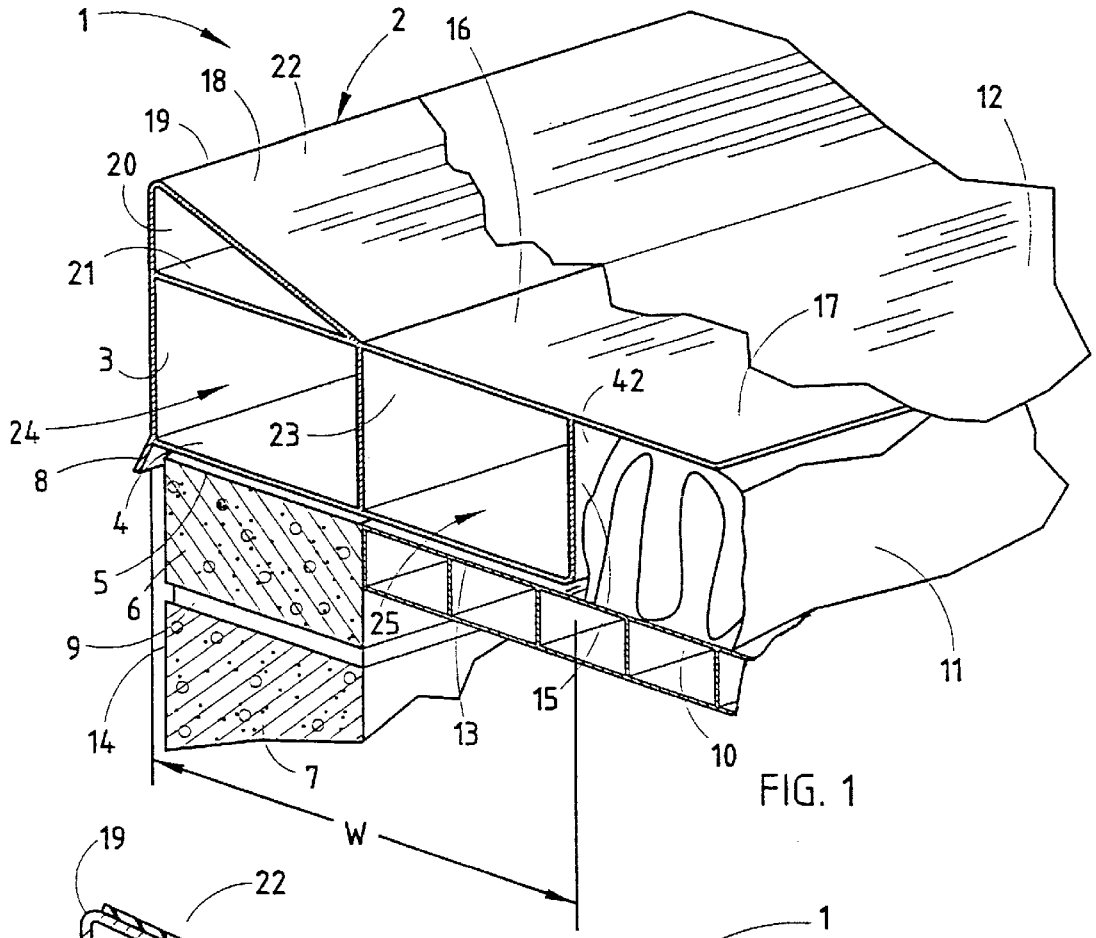
FIG. 1 is a cross-sectional perspective view of the structural termination system.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
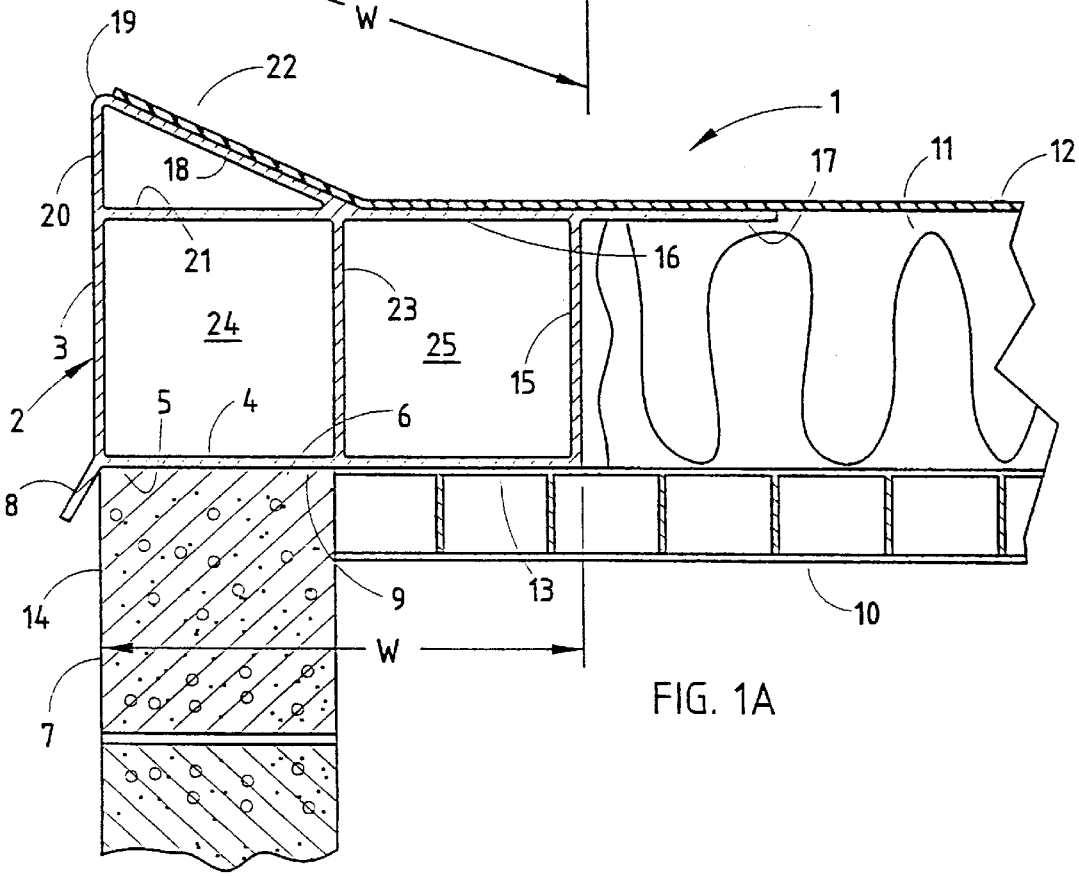
FIG. 1A is a cross-sectional view of the structural termination system.

The reference numeral 1 (FIGS. 1 and 1A) generally designates a structural termination system embodying the present invention. In the illustrated example, structural termination system 1 includes a one-piece elongated structural member 2 defining an outer wall 3 and a horizontal bottom wall 4 defining a lower surface 5 that has substantially the same contour as an upper surface 6 of an associated building wall 7. The building wall 7 is characterized by the absence of a nailer structure. The structural member 2 further includes a drip edge 8 extending downwardly from the outer wall 3 such that the outer wall 3 and the drip edge 8 cooperate to define an integral fascia. Structural adhesive 9 is disposed on the lower surface 5, and securely bonds the structural member 2 directly to the upper surface 6 of the associated building wall 7 without a nailer structure or mechanical fasteners located along the structural member 2. In a preferred embodiment, the elongated structural member 2 is formed of an extruded aluminum. However, it is anticipated that structural member 2 could be fabricated from other materials such as other types of structural metals or polymer materials such as acrylonitrile-butadiene-styrene ("ABS"), polyethylene teraphthalate, ("PET"), or polyvinyl chloride ("PVC") if desired for a particular application.

Flat or low-angle roof systems include a flat structural member such as steel or concrete deck 10 which is supported along the perimeter by the building wall 7. One or more layers of insulation 11 are disposed on the steel deck 10. One or more roofing membrane layers 12 are disposed on top of the insulation 11, and extend over the structural member 2. In the illustrated example, the structural member 2 is bonded directly to a building wall 7. However, it is to be understood that the structural member 2 may be bonded directly to the steel deck 10 at the inward portion 13 of the lower surface 5. Furthermore, for roof constructions having a steel deck that extends substantially to the outer surface 14 of the building wall 7, the structural member 2 is bonded solely to the steel deck, or other roof structure. Because the structural member 2 is structurally bonded directly to the building wall 7 and/or steel deck 10, a wood block nailer structure is not required. Furthermore, because there is no applied external fascia strip or flashing, a wood block nailer structure and cant strip are not required, because no mechanical fasteners are required to secure fascia strips or flashing. Accordingly, the structural termination system 1 of the present invention eliminates the numerous components, including wood block nailer and wood cant strips, as well as eliminating the external flashing and fascia members. Furthermore, the need for extensive, time consuming installation of mechanical fasteners is likewise eliminated. Finally, elimination of mechanical fasteners eliminates penetrations, thereby improving the waterproofing of the roof structure.

The elongated structural member 2 includes an inner wall 15, and an upper wall 16. Roof membrane 12 extends over the upper wall 16, and is securely bonded thereto. Upper wall 16 of structural member 2 extends inwardly to form an insulation retaining flange 17 that fits over the edge of the insulation 11, thereby retaining the edge of the insulation 11. The elongated structural member further includes an upwardly-extending upper wall portion 18 which terminates at an upper edge 19, where the upwardly-extending portion 18 joins with the outer wall 3. The upper portion 20 of the outer wall 3 and the outward portion 21 of the upper wall 16 and the upwardly-extending portion 18 together define an integral gravel stop 22 having a triangular cross-sectional shape. The gravel stop 22 is utilized to retain the loose-laid ballast, or gravel on built-up roofing systems.

The outer wall 3, inner wall 15, upper wall 16, and lower, or horizontal wall 4 define a rectangular perimeter. A web 23 extends vertically across the rectangular perimeter to define a pair of side-by-side rectangular passages 24 and 25. The web 23 provides additional structure to strengthen and/or rigidify the structural member 2 such that the structural member 2 can withstand the forces generated by wind.

The elongated structural member 2 is adhesively bonded directly to the steel deck 10 and/or wall 7 by a waterproof adhesive that preferably has at least 100 pounds per square inch (PSI) sheer strength, with higher strength adhesives of at least 200 PSI also being preferred to provide a secure adhesive bond. In a preferred embodiment, lower surface 5 has a width "W" (FIG. 1) of at least 4.0 inches, thereby providing at least 4800 pounds of shear strength per linear foot of structural member or extrusion 2. If the shear strength of the adhesive is higher or lower than 100 PSI, the width "W" of the lower surface 5 of structural member 2 can be varied to provide the desired 4800 pounds per linear foot bond strength. Although lower strength systems may be adequate for a given application, it is presently preferred that the termination system have at least 4800 pounds per linear foot to provide additional strength. Width "W" can be increased if higher strength is required, and, the shear strength of the adhesive may also be increased if higher strength is required, such as for buildings in geographic areas experiencing high wind velocities. In addition, the adhesive is preferably a thermo-setting elastomeric adhesive to accommodate the dimensional changes of the elongated structural member 2 caused by temperature changes. Furthermore, the adhesive preferably maintains its flexibility to a temperature of −20° F.

Figure 2:
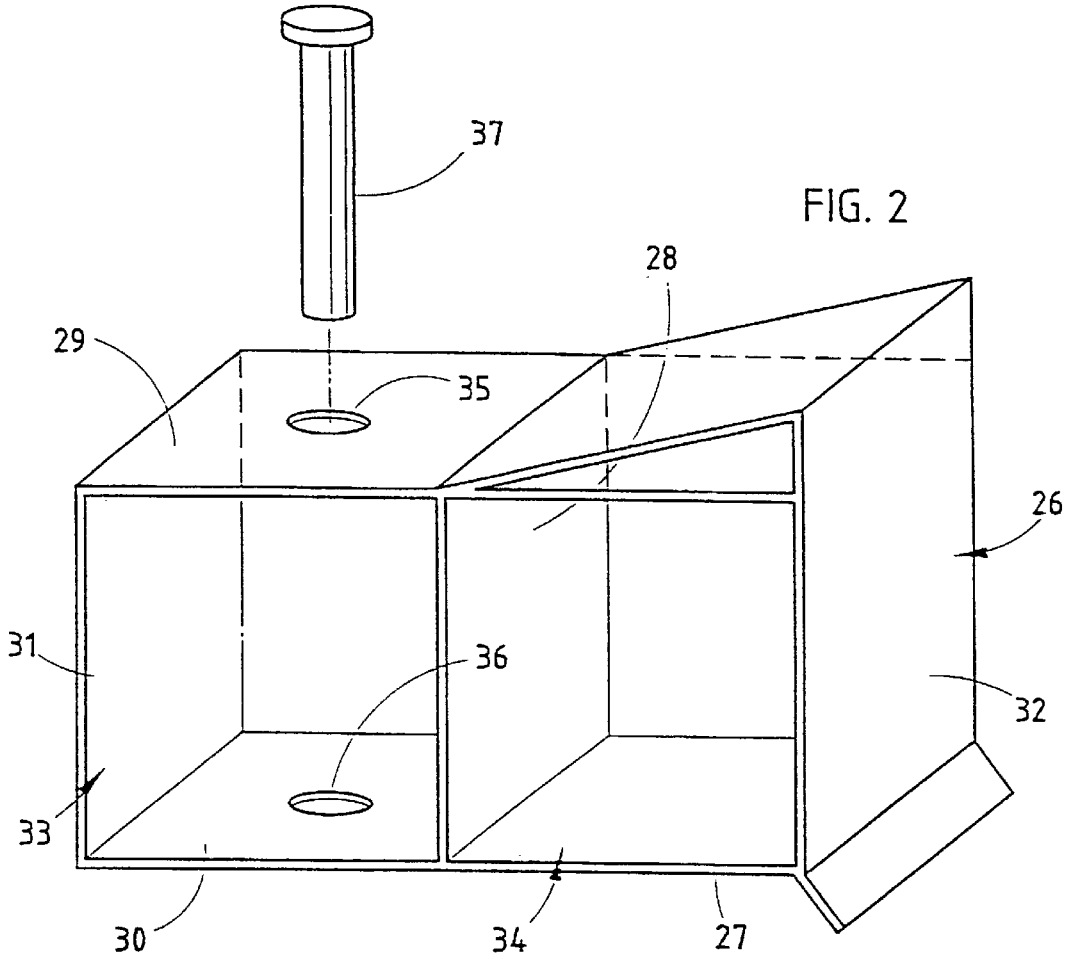
FIG. 2 is a perspective view of the joint member.
Figure 3:
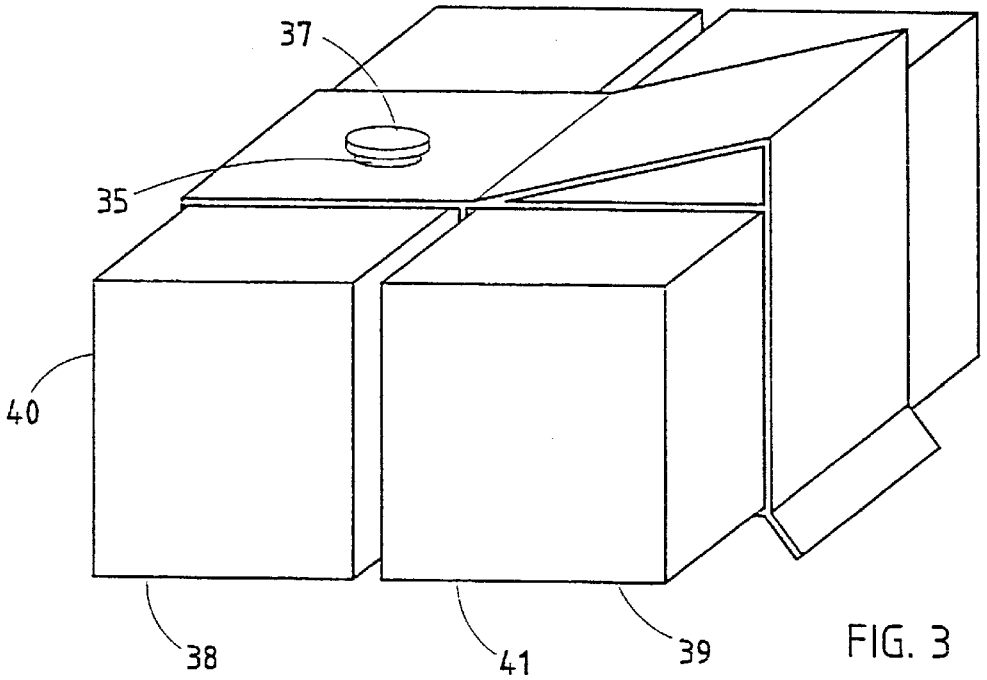
FIG. 3 is a perspective view of the joint member with the polyurethane joint blocks in the installed position.

With reference to FIGS. 2 and 3, a joint member 26 has upper and lower walls 29, 30 and inner and outer walls 31, 32 that define a rectangular perimeter 27 corresponding to the rectangular portion of the elongated structural member 2. A web 28 extends generally vertically between the upper and lower walls 29 and 30 to define a pair of side-by-side rectangular passages 33 and 34. Clearance holes 35 and 36 are provided in upper and lower walls 29 and 30, respectively. An anchor bolt 37 is utilized to anchor the joint member 26 to the building wall and/or roof deck. To install joint member 26 to buildings having a concrete roof deck, anchor bolt 37 is embedded into the structural substrate of the concrete roof deck. Alternatively, anchor bolt 37 is tapped into a structural steel member and/or a bar joist when joint member 26 is installed on a steel deck roof. Anchor bolt 37 secures the joint member 26 and structural member 2 to secure the termination assembly while the adhesive is curing, thereby permitting further assembly of sheet roof components. Anchor bolts 37 also provide additional strength to retain the termination system. A pair of polyurethane blocks 38 and 39 (FIG. 3) are snugly received within the rectangular passages 33 and 34. The polyurethane blocks 38 and 39 have rectangular perimeters 40 and 41, respectively that correspond closely to the rectangular passages 24 and 25 of structural member 2, thereby securing structural member 2 to joint member 26.

At the corners of the roof (not shown), the structural member 2 is diagonally cut, or mitered such as at a 45° angle. A pair of relatively short angle-cut pieces are then welded or otherwise joined along the mitered cut edge to form a corner piece having the same cross-sectional shape as elongated structural member 2. A joint member 26 is used to connect the corner piece to the adjacent elongated, straight structural members 2.

During installation, structural adhesive 9, preferably a two-part, flexible adhesive such as a "Flash Pack" adhesive, manufactured by Chem Link Corporation, Kalamazoo, Mich. is applied to the lower surface 5 of the structural member 2. Alternatively, the structural adhesive 9 may be applied to the upper surface 6 of the building wall 7 and/or the upper surface of the steel deck 10. The structural member 2 is then placed directly on top of the building wall 7 and/or the steel deck 10. The inner edge 42 of the insulation 11 is positioned under the insulation retaining flange 17, and the roofing membrane or membranes 12 are bonded to the upper wall 16 and the upwardly-extending portion 18 of the structural member 2. At the joints, polyurethane blocks 38 and 39 are inserted into the rectangular passages 24 and 25, and may be adhesively bonded utilizing adhesive 9. Anchor bolts 37 are secured to the building wall and/or steel deck 10 at each joint 26.

The structural termination system of the present invention eliminates separate external fascia members of conventional which are prone to wind failure, and also eliminates the wood nailer and wood cant structures which are normally custom-fitted and installed to support the flashing and fascia strips. Furthermore, the extensive use of mechanical fasteners is substantially eliminated, thereby substantially reducing the required labor and associated expenses encountered with conventional wood block roof edge attachment arrangements.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A structural termination system for securing the perimeter of a roof layer to an associated building wall, comprising:

a one-piece elongated structural member having a unitary tubular construction defining an elongated cavity bounded by an outer wall and a horizontal bottom wall defining a substantially flat lower surface having inner and outer edges, said lower surface extending substantially uninterrupted between said inner and outer edges, wherein said termination system is characterized by the absence of a nailer structure, said structural member further including an integral drip edge extending downwardly below said lower surface from said outer wall adjacent said outer edge such that said outer wall and said drip integral fascia; and structural adhesive disposed on said lower surface for securely bonding said structural member directly to an upper surface of an associated building wall without a nailer structure or mechanical fasteners along said structural member.

2. The structural termination system defined in claim 1, wherein said elongated structural member includes an inwardly-extending insulation retainer flange that is vertically spaced-apart from said lower surface.

3. The structural termination system of claim 1, wherein said structural adhesive is a two-part elastomeric adhesive having a shear strength of at least 100 pounds per square inch.

4. A structural termination system for securing the perimeter of a roof layer to an associated building wall, comprising:

a one-piece elongated structural member having an outer wall and a horizontal bottom wall defining a lower surface, wherein said termination system is characterized by the absence of a nailer structure, said structural member further including a drip edge extending downwardly from said outer wall such that said outer wall and said drip edge cooperate to define an integral fascia;

structural adhesive disposed on said lower surface for securely bonding said structural member directly to an upper surface of an associated building wall without a nailer structure or mechanical fasteners along said structural member;

wherein said elongated structural member includes an inwardly-extending insulation retainer flange that is vertically spaced-apart from said lower surface such that an edge of a roof insulation layer can be adapted to be securely retained below said flange;

said elongated structural member having a cross section including a rectangular portion defining said outer wall, said bottom wall, an upper wall, and an inner wall; said cross section further defining a triangular gravel stop above said rectangular portion, said outer wall extending upwardly to define an outer wall of said gravel stop.

5. The structural termination system defined in claim 4, wherein said rectangular portion includes a web extending between said upper and lower walls defining side-by-side quadrilateral portions.

6. The structural termination system defined in claim 5, wherein said structural adhesive is a two-part elastomeric adhesive having a shear strength of at least 100 pounds per square inch.

7. The structural termination system defined in claim 6, wherein said elongated structural member is extruded aluminum.

8. The structural termination system of claim 7, further comprising:

a coupling joint defining at least one protrusion that is closely received within said rectangular portion and defining at least another oppositely-extending protrusion configured for close reception within the rectangular portion of an adjacent elongated structural member to retain the structural members in an end-to-end, linearly aligned configuration.

9. The structural termination system of claim 6, wherein said protrusions of said coupling joint are made of a substantially solid polyurethane material, said coupling joint further including an aluminum sleeve defining substantially the same perimeter shape as said elongated structural member such that when said protrusions are received within the rectangular portions of adjacent elongated structural members, said aluminum sleeve abuts the structural members and forms an uninterrupted joint.

10. A one-piece structural member for securing the perimeter of an associated roof to an associated building wall, said structural member having a tubular cross-sectional shape defining a quadrilateral perimeter with at least one web extending approximately vertically across said perimeter to define a pair of quadrilateral side-by-side passages, a generally planar bottom surface of said structural member defining an area sufficiently large to permit secure bonding of said structural member directly to an upper surface of an associated building wall to thereby secure the perimeter of an associated roof without a nailer structure or mechanical fasteners along the structural member;

said perimeter defining an upper wall, an outer wall, and inner wall, said upper wall extending inwardly beyond said inner wall and defining a retainer flange adapted to extend over and secure an edge of an associated insulation layer of an associated roof;

said planar bottom surface defined by a bottom wall, and wherein said outer wall extends downwardly beyond said planar bottom surface to form a drip edge, said outer wall defining an integral fascia; and a portion of said outer wall extending upwardly beyond said upper wall to define an upper edge, with a sloping wall extending between said upper edge and said upper wall to define a gravel stop.

11. The one-piece structural member as defined in claim 10, wherein said structural member is extruded aluminum.

12. The one-piece structural member as defined in claim 11, wherein said quadrilateral perimeter is rectangular.

13. The one-piece structural member as defined in claim 12, wherein said structural member is configured to be bonded directly to an upper surface of an associated building wall with an elastomeric adhesive having a shear strength of at least 100 pounds per square inch, said bottom wall having a transverse dimension of at least 4 inches such that said structural member will withstand shear force of a least 4800 pounds per linear foot.

14. A building structure including a building wall, a roof having a deck layer, an insulation layer, and a waterproof sheet overlying said insulation layer, said building structure characterized by an absence of nailer structures along said roof, and further including a one-piece structural member securing a perimeter of said waterproof sheet to said building wall, said one-piece structural member having an outer wall and a generally planar upper surface and a generally planar bottom surface that defines an area sufficiently large to permit secure bonding of said structural member directly to said building wall to secure said perimeter without a nailer structure or mechanical fasteners along the structural member;

and wherein said planar upper surface is spaced vertically from said lower surface a distance substantially equal to the thickness of said insulation layer of said roof and providing an attachment location for said insulation layer and said waterproof sheet, said structural member thereby replacing nailer structures and providing a one-piece attachment for the roof perimeter.

15. The building structure defined in claim 14, wherein said planar upper surface extends inwardly to define an insulation-retaining flange that secures an edge of insulation layer.

16. The building structure defined in claim 15, wherein said structural member includes an upwardly sloping portion extending from said planar upper surface to define an integral gravel stop.

17. The building structure defined in claim 15, wherein said structural member defines a generally rectangular cross-sectional shape defining an inner wall that is spaced-apart from said outer wall, and a lower wall that is spaced-apart from said upper surface, said outer wall extending downwardly beyond said lower wall to form a drip edge;

said outer wall and said drip edge defining an integral fascia.

18. The building structure defined in claim 15, wherein said structural member includes a web extending vertically across said rectangular cross section to thereby define side-by-side rectangular passages.

19. The building structure defined in claim 15, wherein said structural member is extruded aluminum.

* * * * *

UNITED STATES PATENT AND TRADEMARK OFFICE

CERTIFICATE OF CORRECTION

PATENT NO. : 6,101,767
DATED : August 15, 2000
INVENTOR(S) : Phillip C. Georgeau It is certified that error appears in the above-identified patent and that said Letters Patent is hereby corrected as shown below:

Column 2,
Line 47, "us" should be -- use --.

Column 5,
Line 29, before "adhesive 9." insert -- structural --.
Line 33, after "conventional" insert -- roof edging system --.
Line 67, after "drip" insert -- edge cooperate to define an --.

Column 6,
Line 62, "claim 6" should be -- claim 8 --.

Column 7,
Line 17, before "inner wall," insert -- an --.
Line 39, "force" should be -- forces --.

UNITED STATES PATENT AND TRADEMARK OFFICE

CERTIFICATE OF CORRECTION

PATENT NO. : 6,101,767
DATED : August 15, 2000
INVENTOR(S) : Phillip C. Georgeau It is certified that error appears in the above-identified patent and that said Letters Patent is hereby corrected as shown below:

Column 8,
Line 27, "claim 15" should be -- claim 16 --.
Line 36, "claim 15" should be -- claim 17 --.
Line 40, "claim 15" should be -- claim 18 --.

Signed and Sealed this

Seventh Day of August, 2001

*Attest:*

Nicholas P. Godici

*Attesting Officer*

NICHOLAS P. GODICI
*Acting Director of the United States Patent and Trademark Office*